US005925198A

United States Patent [19]

Das

[11] Patent Number: 5,925,198

[45] Date of Patent: Jul. 20, 1999

[54] NICKEL-BASED SUPERALLOY

[75] Inventor: Niranjan Das, Hyderabad, India

[73] Assignee: The Chief Controller, Research and Developement Organization Ministry of Defence, Technical Coordination, New Delhi, India

[21] Appl. No.: 08/813,333

[22] Filed: Mar. 7, 1997

[51] Int. Cl.[6] ..... C22C 19/05

[52] U.S. Cl. ..... 148/410; 148/404; 148/428; 420/448

[58] Field of Search ..... 420/448; 148/404, 148/410, 428

[56] References Cited

U.S. PATENT DOCUMENTS 5,366,695 11/1994 Erickson ..... 420/448

*Primary Examiner*—George Wyszomierski

*Attorney, Agent, or Firm*—Venable; George H. Spencer; Ashley J. Wells

[57] ABSTRACT

A Ni-based superalloy consists of from 1.4 to 4.4 wt % of Cr; from 3 to 8 wt % of Co; from 5 to 7.5 wt % of W; from 4.8 to 7.5 wt % of Re; from 7.5 to 10 wt % of Ta; from 4.8 to 5.8 wt % of Al; from 0.1 to 0.2 wt % of Hf; from 0.1 to 0.5 wt % of Nb; from 0.01 to 0.05 wt % of Y; and balance Ni.

3 Claims, 5 Drawing Sheets

NICKEL-BASED SUPERALLOY

BACKGROUND OF THE INVENTION

1. Field of the Invention

This invention relates to a process for the preparation of Ni-based superalloys and articles thereof.

2. Description of the Related Art

The performance of gas turbine engines is limited by the high temperature capability of turbine blades and nozzle guide vanes (NGV). These blades and vane parts operate in extremely hostile environment of high temperatures, high stresses, oxidation and hot-corrosion as high pressure hot combustion gas-air containing highly corrosive ingredients is directed against NGV parts at high velocity in such engines and the gas then imparts its theremo-kinetic energy to the turbine rotor blades. Ni-base single crystal superalloys have so far surpassed other materials in performance, in such environments. Among these single crystal superalloys the Re-bearing alloy CMSX-4 was performing earlier with highest turbine entry temperature (TEL) in a variety of aero-engines. Further improvements have been reported where an alloy CMSX-10 has been developed incorporating about 5 to 7 wt % if Re as compared to 3 wt. % Re in CMSX-4. This alloy has exhibited highest ever creep resistance among the prior art materials upto the temperature of 1150 C. together with reasonable oxidation and hot-corrosion resistance. This was owing to its higher total refractory element (W+Re+Mo+Ta) content cf 20.7 wt % together with higher Re content as compared to 16 and 3 wt. % respectively in CMSX-4 alloy. Sluggish diffusion of heavy refractory elements is known to enhance high temperature creep resistance in the gas turbine operating load and temperature conditions. Further rise in total refractory element content with the alloying combination of CMSX-10 however has not been possible because of phase instability that deteriorates creep resistance considerably. There is, therefore a need for the preparation of such Ni-based single crystal superalloys wherein total refractory content can be favourably increased beyond that of CMSX-10 alloy in order to achieve superior creep resistance along with enhancement in other useful characteristics like single crystal processability.

The turbine blades and vanes being essential elements of the engine, even a minor improvement in material characteristics has significant effect on the performance economics and life of the engine. More 10° C. improvement in metal temperature capability can roughly double the component life and just 1° C. advance in metal temperature capability amounts to 4–5° C. increase in TET of hot combustion gas through blade cooling principle. Higher TET leads to better thermal efficiency, greater thrust and reduction in fuel consumption.

Another disadvantage of the processes in the known art is the requirement of ceramic cores for making hollow components like gas turbine blades and vanes, which leads to higher rejection of components as compared to the process proposed in the present invention.

Further disadvantage of the process known in the art is the molten alloy and ceramic core reaction that leads to appreciable loss of key alloying elements which is turn leads to performance deterioration in the materials.

The primary object cf the present invention is to propose a Ni-based superalloy and articles made therefrom having higher refractory element content beyond that of CMSX-10alloy and heat treated to achieve superior creep resistance, adequate resistance to oxidation, hot-corrosion and deleterious phase formation for application such a gas turbine blades and vanes.

An object of the present invention is to propose a Ni-based superalloy with excellent castability of advanced gas turbine blades and vanes in single crystal from having thin walled aero-foils, shrouded segments and intricate cooling channels.

A further object of the present invention is to propose a process for preparation of hollow single crystal superalloy components having complex cooling channels without employing ceramic cores thereby improving the yield of quality components.

Yet a further object of the present invention is to propose a Ni-based superalloy and articles made therefrom that can be heat treated without causing any recrystallization to achieve improved balance of critical mechanical properties for advanced gas turbine engine application.

A still further object of the present invention is to propose a Ni-based superalloy and articles made therefrom that can be conveniently brazed and given protective coating by existing manufacturing techniques during heat treatment.

These and other objects and advantages will be more clearly understood from the following detailed description, drawings and specific examples which are intended to be typical of, rather than in way limiting on the scope of the present invention.

SUMMARY

According to this invention there is provided a Ni- based superalloy comprising of:

in weight percentage of 1.4–4.4. Cr, 3–8 Co, 5–7.5 W, 4.8–7.5 Re, 7.5–10 Ta, 4.8–5.8 Al, 0.1–0.2 Hf, 0.1–0.5 Nb, 0.01–0.05 Y, balance essentially being Ni.

The Ni-based superalloy has W+Re present about 12, Al+Ta+Nb+Hf being about 13.8–15.5 and total refractory elements W+Re+Ta+Hf+Nb being about 20.7–2.8 and the charge being substantially free of Sulphur and Vanadium.

The preferred range of different alloying elements are by weight percentage of about 1.8–3.8 Cr, 4–6.4 Co, 5.2–6.8 W, 5.8–7.2 Re, 7.5–9.5 Ta, 5.2–5.8 Al, 0.3–0.5 Nb , 0.1–0.2 Hf, 0.02–0.04 Y. The most preferred range of the different alloying elements by weight percentage are 1.8–3 Cr, 4–6.4 Co, 5.2–6.0 W, 6.0–7.2 Re, 8.5–9.5 Ta, 5.2–5.6 Al, up to 0.3 Nb, 0.1–0.2 Hf, 0.02–0.04 Y, the sum of W+Re is about 12 the sum of Al+Ta+Nb+Hf is in the range of 14.2 to 15.5 and the total refractory element (W+Re+Nb+Hf) is in the range of 21–4.

Further according to the present invention there is provided a process for the preparation of a Ni-based superalloy article comprising in the steps of:

a) preparing an alloy charge by mixing in weight percentage of 1.4–4.4 Cr, 3–8 Co, 5–7.5 W, 4.8–7.5 Re, 7.5–10 Ta, 4.8–5.8 Al, 0.1–0.5 Nb, 0.1–0.2 Hf, 0.01–0.05 Y, the balance being essentially Ni;

b) melting the alloy charge of step (a):

c) pouring the said melt into a mould;

d) withdrawing the mould containing melt;

e) subjecting the melt to a step of freezing;

f) removing and cleaning each pair of cast longitudinal halves and subjecting them to solution heat treatment:

g) subjecting the brazed and solutionised components obtained by steps (f) to a step of quenching;

h) subjecting the above to a multistep ageing treatment.

The alloy charge is melted in a vacuum induction melting furnace, at a temperature such as 1500° C. A ceramic mould is prepared employing investment shell moulding technique to have several cavities in pairs of two longitudinal halves of each component where each pair being connected at the bottom to a grain selector or seed crystal cavity. The ceramic mould prepared is pre-heated to a temperature of about 1500° C. in a vacuum melting and casting furnace and said melt is poured into the mould.

The ceramic mould containing melt is withdrawn from the mould-heater of the vacuum melting and casting furnace, across a desired temperature gradient to induce single crystal freezing of the melt, either by radioactive heat transfer to the water-cooled furnace chamber or by conduction into a low melting pool of liquid metal such as aluminium. The mould design described in step (c) ensures identical crystallographic orientation for the two longitudinal halves of the component in each pair.

Each pair of cast longitudinal halves is removed and cleaned and subjected to solution heat treatment in a stepped manner between 1315 to 1360° C. for about 24 hours, the peak soaking temperature being at least 10° C. below the alloy incipient melting temperature. During this solution heat treatment, the two cast halves are held against each other along their matching plane of slice incorporating desirable braze-filler material so that a complete single crystal component having intricate cooling channels would form by brazing of the two halves simultaneously along with solutionisation.

The brazed and solutionised components are subjected to argon gas fan quenching followed by a multi-step ageing treatment in order to precipitate the γ'-particles within the γ-matrix. In the first step the components are heated to about 1180° C. and held there for about 4 hours. In the next ageing-step, the components are given simulated coating treatment of holding at about 1140° C. for about 4 hours. Next, the components are aged at about 870° C. for about 20 hours and finally cooled down to the ambient temperature. The ageing treatment is not limited to this preferred heat treatment sequence, but instead may be accomplished by any acceptable manner which provides the desired volume fraction of γ'- particles in somewhat regular array, cubical shape and uniform size around 0.5 μm.

The articles of the present invention are particularly suitable for use as turbine blades and vanes in advanced gas turbine engines owing to their excellent high temperature mechanical and environmental properties, as well as their alloy phase stability. Other features and advantages of the present invention will become apparent from more detailed descriptions, taken in conjunction with the accompanying drawings, which illustrate, by way of example, the principles of the invention.

Figure 1:
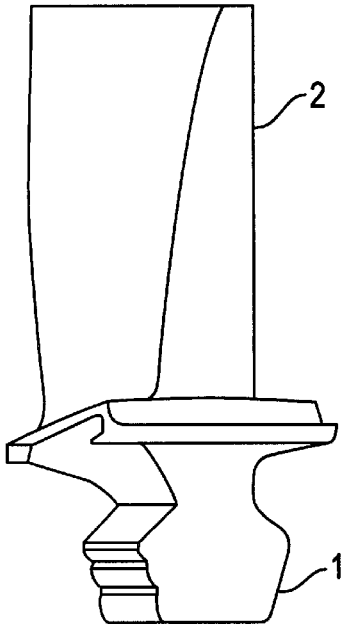
FIG. 1 is a perspective view of a gas turbine blade.

Table 1 and 2 show composition, creep-oxidation and hot-corrosion behaviour of a number of prior art single alloy (ref. 1–2) and the alloys prepared in the present invention. The alloys with designations as DMS-1, DMS-2, DMS-3, DMS-4, DMS-5 and DMS-6 are the examples in the board range. The preferred range includes the alloys designated as DMS-2, DMS-3, DMS-4, and DMS-5. The alloy DMS-3, DMS-4, DMS-5 are in the most preferred range of composition.

TABLE 1

| | Nominal Composition, weight % | | | | | | | | | | | |
|---|---|---|---|---|---|---|---|---|---|---|---|---|
| Alloy | Cr | Co | W | Re | Mo | Ta | Nb | Hf | Y | Ti | AI | Ni |
| DMS-1 | 4.4 | 8.0 | 7.5 | 4.8 | — | 8.6 | 0.1 | 0.1 | 0.01 | — | 5.49 | BAL |
| DMS-2 | 3.8 | 4.8 | 6.8 | 5.8 | — | 7.5 | 0.5 | 0.1 | 0.02 | — | 5.78 | BAL |
| DMS-3 | 3.0 | 4.5 | 6.0 | 6.0 | — | 8.6 | 0.3 | 0.1 | 0.04 | — | 5.36 | BAL |
| DMS-4 | 2.4 | 4.0 | 5.5 | 6.5 | — | 9.0 | 0.3 | 0.1 | 0.02 | — | 5.18 | BAL |
| DMS-5 | 1.8 | 6.4 | 5.2 | 7.2 | — | 9.5 | 0.3 | 0.2 | 0.03 | — | 5.47 | BAL |
| DMS-6 | 1.4 | 3.1 | 5.0 | 7.5 | — | 10 | 0.2 | 0.1 | 0.05 | — | 4.75 | BAL |
| CMSX-2 | 8.0 | 5.0 | 8.0 | — | 0.6 | 6.0 | — | — | — | 1.0 | 5.6 | BAL |
| CMSX-4 | 6.5 | 9.0 | 6.0 | 3.0 | 0.6 | 6.5 | — | 0.1 | — | 1.0 | 5.6 | BAL |
| Rene N5 | 7.0 | 8.0 | 5.0 | 3.0 | 2.0 | 7.0 | — | 0.2 | — | — | 6.2 | BAL |
| Rene N6 | 4.25–6.0 | 10.0–15.0 | 5.0–6.5 | 5.1–5.6 | 0.5–2.0 | 7.0–9.25 | 0–1.0 | 0.1–0.5 | 0–0.03 | — | 5.0–6.25 | BAL |
| CMSX-10 | 1.8–4.0 | 1.5–9.0 | 3.5–7.5 | 5.0–7.0 | 0.25–2.0 | 7.0–10.0 | 0–0.5 | 0–0.15 | — | 0.1–1.2 | 5.0–7.0 | BAL |

*plus 0.02–0.07%C, 0.003–0.01% B, 0–0.03% Y, 0–6% Ru.

TABLE 2

| | Creep-Rupture Life (Hours) , Hot Corrosion and Oxidation Weight Loss | | | | | | | |
|---|---|---|---|---|---|---|---|---|
| Alloy | 850° C. at 500 Mpa | 950° C. at 240 Mpa | 1050° C. at 140 Mpa | 1100° C. at 120 Mpa | 1150° C. at 90 Mpa | 1200° C. at 70 Mpa | Corrosion $mg/cm^2$ | Oxidation $mg/cm^2$ |
| DMS-1 | 2568 | 3468 | 1469 | 498 | 485 | 182 | 348 | 7.2 |
| DMS-2 | 2696 | 3721 | 1592 | 572 | 593 | 213 | 437 | 6.8 |

TABLE 2-continued

| Alloy | 850° C. at 500 Mpa | 950° C. at 240 Mpa | 1050° C. at 140 Mpa | 1100° C. at 120 Mpa | 1150° C. at 90 Mpa | 1200° C. at 70 Mpa | Corrosion mg/cm$^2$ | Oxidation mg/cm$^2$ |
|---|---|---|---|---|---|---|---|---|
| | Creep-Rupture Life (Hours) , Hot Corrosion and Oxidation Weight Loss | | | | | | | |
| DMS-3 | 3054 | 3825 | 1752 | 584 | 623 | 261 | 358 | 8.3 |
| DMS-4 | 3243 | 3917 | 1803 | 592 | 650 | 281 | 327 | 7.4 |
| DMS-5 | 2721 | 3764 | 1648 | 583 | 590 | 232 | 432 | 7.2 |
| DMS-6 | 2537 | 3427 | 1423 | 487 | 473 | 167 | 492 | 7.9 |
| CMSX-2 | 450 | 380 | 270 | 166 | — | — | 580 | 8.5 |
| CMSX-4 | 917 | 953 | 468 | 377 | 435 | — | 533 | 8.0 |
| CMSX-10 | 2736 | 3711 | 1612 | 579 | 580 | 214 | 607 | 8.9 |
| Rene N-5 | 805 | 837 | 416 | 319 | 387 | — | 453 | 7.3 |
| Rene N-6 | 2458 | 3475 | 1359 | 431 | 413 | 157 | 522 | 7.1 |

DESCRIPTION OF THE PREFERRED EMBODIMENTS

Figure 2:
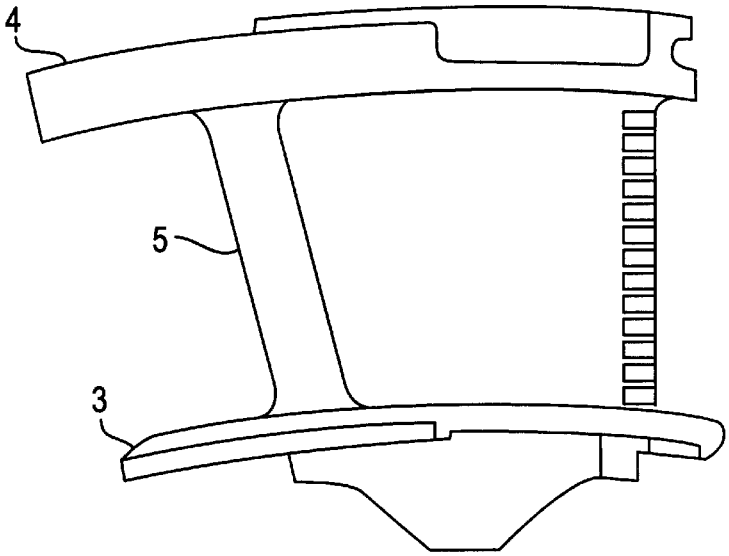
FIG. 2 is a perspective view of a gas turbine vane.

As shown in the FIGS. 1 & 2 for the purpose of illustration, the present invention is embodiment in a single crystal Ni-base superalloy article such as a turbine blade or vane used in a gas turbine engine. The blade has a root section 1 for attachment to a turbine wheel (not shown) and the vane has an inner shroud 3 and an outer shroud 4 to from respectively the inner and outer rings upon assembly. The blade and the vane also have hollow aerofoil sections 2 and 5 respectively upon which a hot gas stream impinges. The gas swept areas of these articles are typically coated with a thin layer of an oxidation and corrosion resistance coating of about 100 $\mu$m thickness. The present invention is concerned with the underlying component or substrate, and not with the coating. Nevertheless, the substrate alloy composition and structure are chosen so as to be compatible with the necessary coatings.

Figure 3:
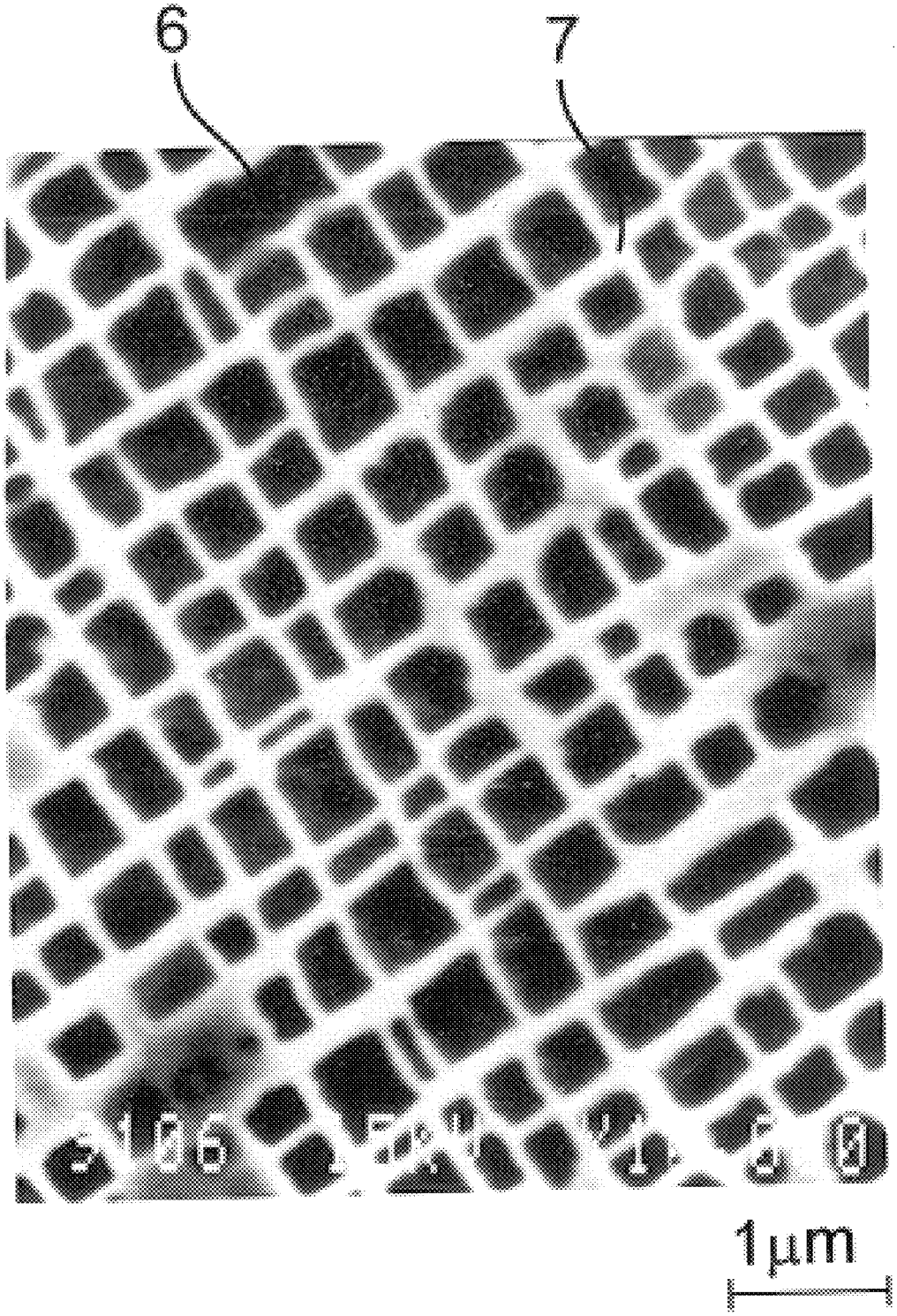
FIG. 3 is a sectional micro-graph of a single crystal superalloy made in accordance with a preferred embodiment of the invention.

The article of the present invention, such as the turbine blade or vane, is necessarily formed by growing a single grain along <001> crystallographic direction with is nearly parallel to the major stress axis of the article. As illustrated in FIG. 3 the microstructure of the completed article typically comprises of a uniform distribution of Ni3Al type cubcoidal gamma-prime (γ') precipitates 6 in a gamma (γ) matrix 7 of Ni-base solid solution.

Figure 5:
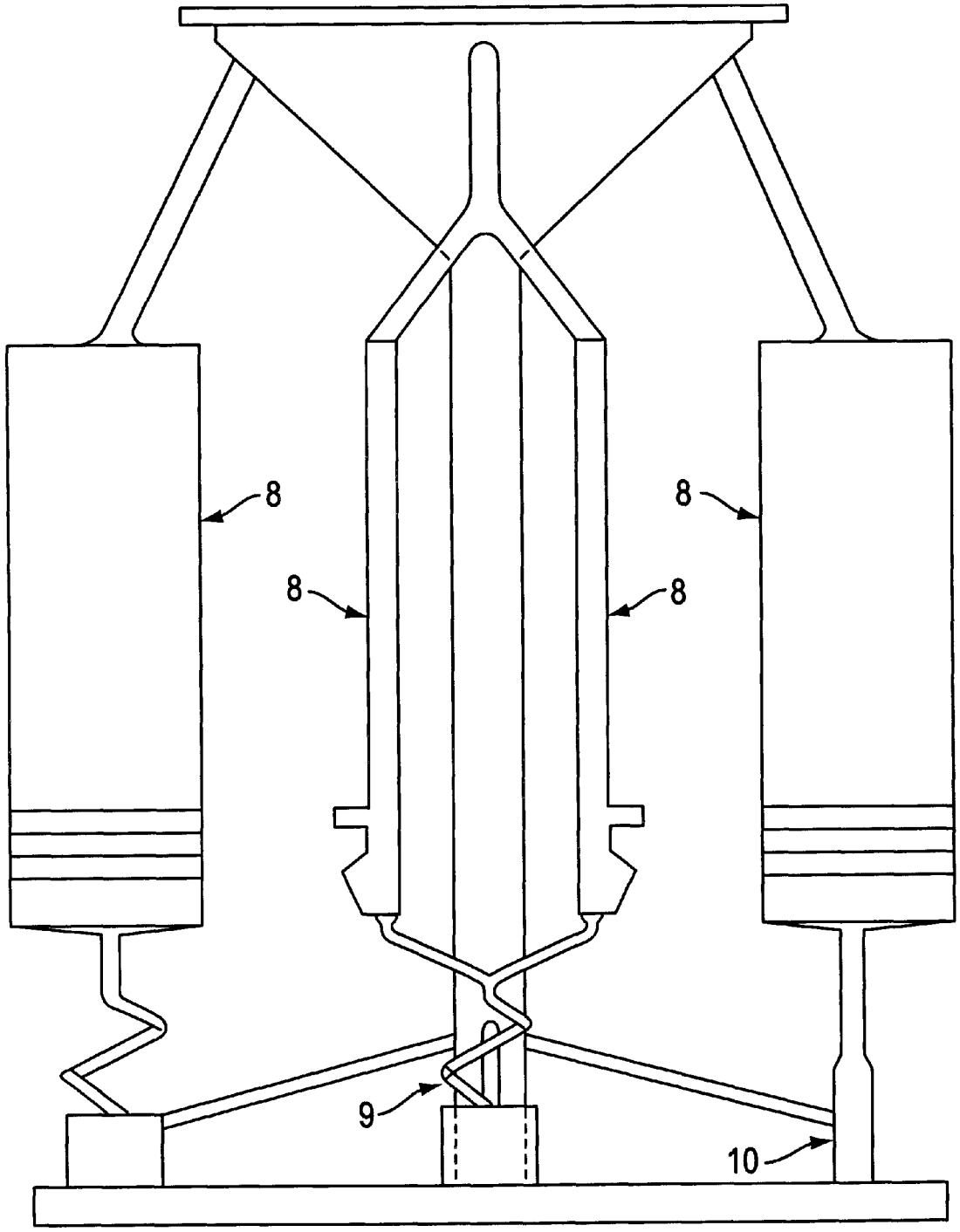
FIG. 5 is a schematic of wax cluster design for growing several pairs of longitudinal single crystal halves of a component maintaining identical crystallographic orientation in each pair.

Any fabrication technique which produces a substantially single crystal article is operable in conjunction with the present invention the preferred technique, used to prepare the single crystal articles described through the examples herein, is to prepare the molten metal of desired composition and pour the melt into a hot (about 1500° C.) refractory shell mould with cavitie corresponding to the wax cluster design as shown schematically in FIG. 5. The mould thus has several cavities of desired shape in pairs of longitudinal halves (8) of each component where each pair being connected at its bottom to one helical grain selector (9) or one seed crystal (10) cavity in order to ensure identical crystallographic orientation in the two longitudinal halves of each pair. The temperature of the shell mould and the melt inside is maintained with the help of electrical mould heater. Controlled withdrawal of mould out of the mould-heater across a steep temperature gradient induces single crystal freezing of the melt inside the mould as the heat is unidirectionally transferred either by conduction to a liquid pool of low melting metal or by radiation to the water-cooled furnace chamber. Each pair of longitudinal component halves are then brazed during heat treatment to form a hollow single crystal component.

The present invention provides a unique combination of alloying elements which results in a nickle-base superalloy that is particularly suitable for casting single crystal articles to exhibit a combination of improved mechanical properties and resistance to oxidation and hot corrosion. An overall improvement in the combination or critical properties has not been recognised prior to this invention. Single crystal superalloys resulting from alloying of Ni—Al binary system used to exhibit outstanding performance characteristics by virtue of their low modulus growth texture of f.c.c. matrix phase (γ) together with ordered f.c.c. coherent (γ') precipitates in optimum size, distribution and volume fraction. Alloying in the prior art has amounted to considerable depression in multicomponent liquidus, solidus and solvus surfaces as compared to the Ni—Al binary phase fields. The best alloy should therefore correspond to that combination of alloy elements which would push every high temperature characteristic to the highest possible extent including the liquidus, solidus and solvus surfaces of multicomponent γ and γ' phases. The alloy data and together with the binary and ternary phase diagrams of nickel and aluminium with various alloying elements indicate.

Addition of W and Re into Ni—Al system would amount to minimum depression of liquidus and maximum strengthening per unit solute atom. In fact, the isomorphic liquidus and solidus surfaces goes up to as much as 1620° C. in Ni—Re and up to 1510° C. in Ni—W system.

Tantalum is the only γ'-strengthener available which would depress the alloy liquidus and the solidus surfaces to the minimum extent as compared to any other γ'-strengthener having Al like partitioning characteristics. It in fact elevates the solvus surface and also counter acts against the density inversion of interdendritic liquid as W and Re would partition into the freezing dendrites. Tantalum also improves corrosion resistance by inhibiting surface alumina formation.

Chromium is known for its excellent oxidation resistance at intermediate temperature but it depresses the alloy liquidus, solidus and solvus considerably. Addition of chromium therefore has to be restricted to the bare minimum or may be replaced by other elements such as Re and Ru which are not only capable of improving hot corrosion resistance but also elevating the alloy liquidus solidus and are more effective strengtheners of γ and γ' phase.

A multicomponent superalloy can be considered as a psudobinary of Ni-like and Al-like elements from the point of view of chemical partitioning as long as it is exhibiting identical phase reactions of Ni—Al binary system. Partitioning of transition elements between dendrites and interdendritic regoins can be seen to be more strongly dependant on electro-negativity than on atomic size or any other factor according to the electron probe microanalysis of superalloys in as-cast condition. Solid-state solute partitioning between γ and γ' also exhibits similar trend for most of the alloying elements according to their γ' solubility lobes in Ni—Al—X ternary systems. Cobalt, rhenium and tungsten with electronegativity of 1.8, 1.9 and 1.7 respectively (electronegativity of Ni is 1.8) are always found to partition like nickel into the freezing dendrites. Mn, Ta and Ti with 1.5 electronegativity and Zr with electronegativity of 1.4 are always found to partition like Al (electronegativity of Al is 1.5) into the interdendritic liquid. The atom percent of Cr (being with intermediate electronegativity of 1.6) can be treated as 50% Ni-type and 50% Al-type for psudobinary consideration.

Maximum ratio of dendrite to interdendritic volume along with maximum volume fraction of γ'-phase nad the highest solvus temperature can be expected around the binary solid-solubility limit of ~20 atom %. of Al in Ni. However, the non-equilibrium nature of industrial solidification is bound to result in considerable amount of eutectic freezing. In a multicomponent system this eutectic freezing will be even more pronounced owing to wider gap between liquidus and solidus surfaces. The present alloy as therefore been designed a little away from the binary solidsolubility limit of 20 atom percent towards nickel-rich side in a psudobinary frame at about 18 atom percent of aluminium-type atoms where the optimum combination of reasonable gap between solidus and solvus would exist with maximum ratio of primary gamma phase and eutectic-γ-γ' volume fractions.

Cobalt has been added to the nickel-base superalloy in order to: a) improve creep resistance as it lowers the stacking fault energies of both the phases (γ and γ') which in turn discourages dislocation climb; b) improve hot corrosion resistance as it reduces the diffusivity of sulphur. Diffusivity of sulphur in cobalt is nearly one hundredth of that in nickel. Cobalt also reduces gamma-prime coarsening rate. This characteristic is understood to improve creep resistance of cobalt bearing bickel-base superalloys.

Figure 4:
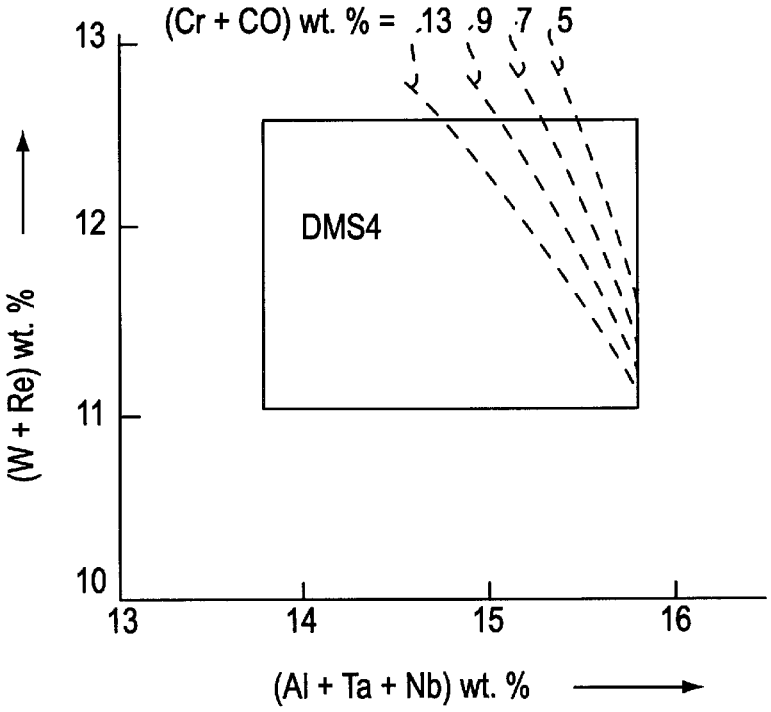
FIG. 4 is a graph of the phase stability field of alloys.

The high temperature strength, creep resistance and allowable limit of operating temperature for any alloy now would be in direct proportion to the extent of its refractory alloying, i.e., W and Re content. As much as 4.5 atom percent of W+Re could be incorporated into the 82% of nickel-type atoms by limiting the Co+Cr content to as low as 6 atom percent and eliminating Mo altogether. FIG. 4 shows how the phase-stable-field for DMS-series of alloys shifts towards higher of W+Re and Al+Ta+Nb content by decreasing the Cr+Co content of these alloys Excellent resistance to hot corrosion and oxidation could be achieved simultaneously by maintaining Cr+Re content at about 5 atom % and micro-alloying with Nb, Hf and Y.

Single crystal process ability of this alloy could be achieved in spite of its high W+Re content (which is prone to freckling) by incorporating as much as 3 atom percent of Ta instead of keeping any Ti. Micro-alloying with not more than 0.08 atom % of Hf resulted in better cast ability with respect to thin walled airfoil components by virtue of increased fluidity of interdendritic liquid, enhanced hot ductility and inter dendritic cohesion against hoop stress. Higher amount of Hf would decrease the alloy incipient melting temperature, enlarge solidification range and increase eutectic volume fraction that would hardly solutionise. This combination of alloying with A, Nb, Hf and γ together with substantial fraction of Re has provided excellent intrinsic strength of γ' precipitates and resistance to γ'-coarsening. The weight percent of total refractory elements (W+Re+TR+Hf+Nb) has been kept within a range of 20.7 to 22.8 in order to maximise creep resistance at very high operating temperature and yet avoid deleterious phase formation.

The alloy composition that has been found suitable for the above mentioned processing conditions and provides far more excellent high temperature strength and corrosion resistance than the conventional superalloys is essentially consisting in weight percent of about 1.4–4.4 Cr, 3–8 Co, 5–7.5 W, 4.8–7.5 Re, 7.5–10 Ta, 4.8–5.8 Al, 0.1–0.2 Hf, 0.1–0.5 Nb, 0.01–0.05 Y, balance essentially Ni, wherein the sum of W+Re is about 12, the sum of Al+Ta+Hf+Nb is from about 13.8 to 15.5 and the total refractory elements (W+Re+Ta+Hf+Nb) is from about 20.7 to 22.8, the alloy being substantially free of S and V. The preferred micro structure of the article, after heat treatment, is an array of precipitates in a matrix as illustrated in FIG. 3. The matrix is nickel along with the solid solution strengthening elements and is termed as γ phase. In addition to solid solution strengthening, the strength of the article is promoted by precipitation hardening. The precipitates are formed as inter metallic compound of Ni, Al, Ta, Hf and Nb, the compound being known as γ' phase having a composition at Ni3 (Al,Ta,Hf,Nb). It is desirable that the volume fraction of the γ phase be maintained at a high level, preferably in the range from about 65 to 70 volume %.

To achieve this quantity of the γ' phase, Al is present in an amount from about 4.8 to 5.8 wt. %, Ta is present in an amount from about 7.5 to 10 wt. %, Hf is present in an amount from about 0.1 to 0.2 wt. % and Nb is present in an amount from about 0.1 to 0.5 wt. %. If lower levels of these γ' forming elements are utilised, the volume fraction of γ' precipitates becomes too low, and consequently the tensile and creep strengths go below acceptable levels. Too high levels of γ' forming elements result in excessive volume fraction of eutectic γ' phase. Since the eutectic γ' is highly alloyed with elements which depress the melting temperature, the alloy becomes less responsive to solution heat treatment that would dissolve all or most of the eutectic-γ'. Hence the full potential strength of the alloy can not be realised. The Ta content of the alloy is kept above the levels typically used in earlier superalloys containing Re, in order to improve high temperature creep resistance through higher solvus temperature, larger γ' volume fraction and minimum lattice mismatch between γ and γ' phases.

Hf is present in an amount from about 0.1 to 0.2 wt. % in order to enhance hot ductility and inter-dendrite or intergranular cohesion against hoop stress which otherwise causes grain boundary cracking during solidification of hollow castings around ceramic cores. Hf also promotes resistance to environmental damages by oxidation. Lower levels of Hf have been found to be inadequate for the above mentioned purpose and higher levels have been found to depress the eutectic melting temperature so much that the alloy becomes less responsive to solution heat treatment.

Co and Cr are present in an amount from about 3 to 8 wt. % and 1.4 to 4.4 wt. % respectively in order to enhance hot corrosion resistance. Lower than these levels have been found to be associated with inadequate hot corrosion resistance and at levels higher than the above mentioned upper limit harmful σ phase and $\mu$ phase occur which lower the high temperature strength of the alloy.

W is present in an amount from about 5 to 7.5 wt. % in order to increase high temperature strength of the alloy. Less than 5 wt. % of W leads to lower than acceptable level of high temperature strength. Higher than 7.5 wt. % of W leads to every poor hot corrosion resistance and deleterious α phase formation. Re is present in an amount from about 4.8 to 7.5 wt. % in order to enhance high temperature strengh, reduce γ' coarsening and improve hot corrosion resistance. Less than 4.8 wt. % of Re leads to lower than acceptable level of high temperature strength and hot corrosion resistance. Higher than 7.5 wt. % of Re leads to formation of Re rich needle phase and lower creep resistance. The ratio of (W+Re)/Ta has been reduced as compared to earlier superalloys containing Re in order to promote alloy castability by avoiding density inversion and freckling.

Y and Nb are present in an amount from about 0.01 to 0.05 wt. % and 0.1 to 0.5 wt. % respectively in order to improve oxidation and hot corrosion resistance. Less than the lower levels have been found to be inadequate for the above mentioned purpose. Higher than the upper limits have led to considerable depression of alloy incipient melting and therefore inadequate solutioning of eutectic γ'.

EXAMPLES

For preparation of 5 Kg of Ni-base superalloy designated as DMS-4 (table-1) and single crystal gas turbine blades, vanes and test-pieces therefrom, alloy charge of 120 gm of Cr, 200 gm of Co, 275 gm of W,325 gm of Re,400 gm of Ta, 15 gm of Nb, 60 gm of Hf, 1 gm of Y, 259 gm of Al, and balance Ni is prepared. The alloy charge is melted in the vacuum induction melting furnace at temperature around 1500° C. The molten alloy is poured into ceramic mould (prepared as per step (c) of the process) pre-heated to 1500° C. Each mould has provision for casting multiple articles. Specifically, the mould has provision for three rectangular slabs, each having a length of 200 mm, a breadth of 30 mm and a width of 10 mm and two gas turbine parts having configuration generally similar to that illustrated in FIGS. 1 & 2. The mould containing molten alloy is gradually withdrawn at a controlled rate across a desired temperature gradient to induce directional solidification of the molten alloy.

The cast components are removed and cleaned and are subjected to multi-step solution heat treatment and brazing as per above description in step (f) of the process. The solutionised and brazed components are subjected to multi-step ageing treatment as per step (g) of the process. The FIG. 3 illustrates the typical microstructure of the fully heat treated components. The γ'-precipitates occupy at least 65 volume percent and have generally well aligned cubic morphology with cube edges in size range of about 0.3 to 0.7 μm.

Figure 6:
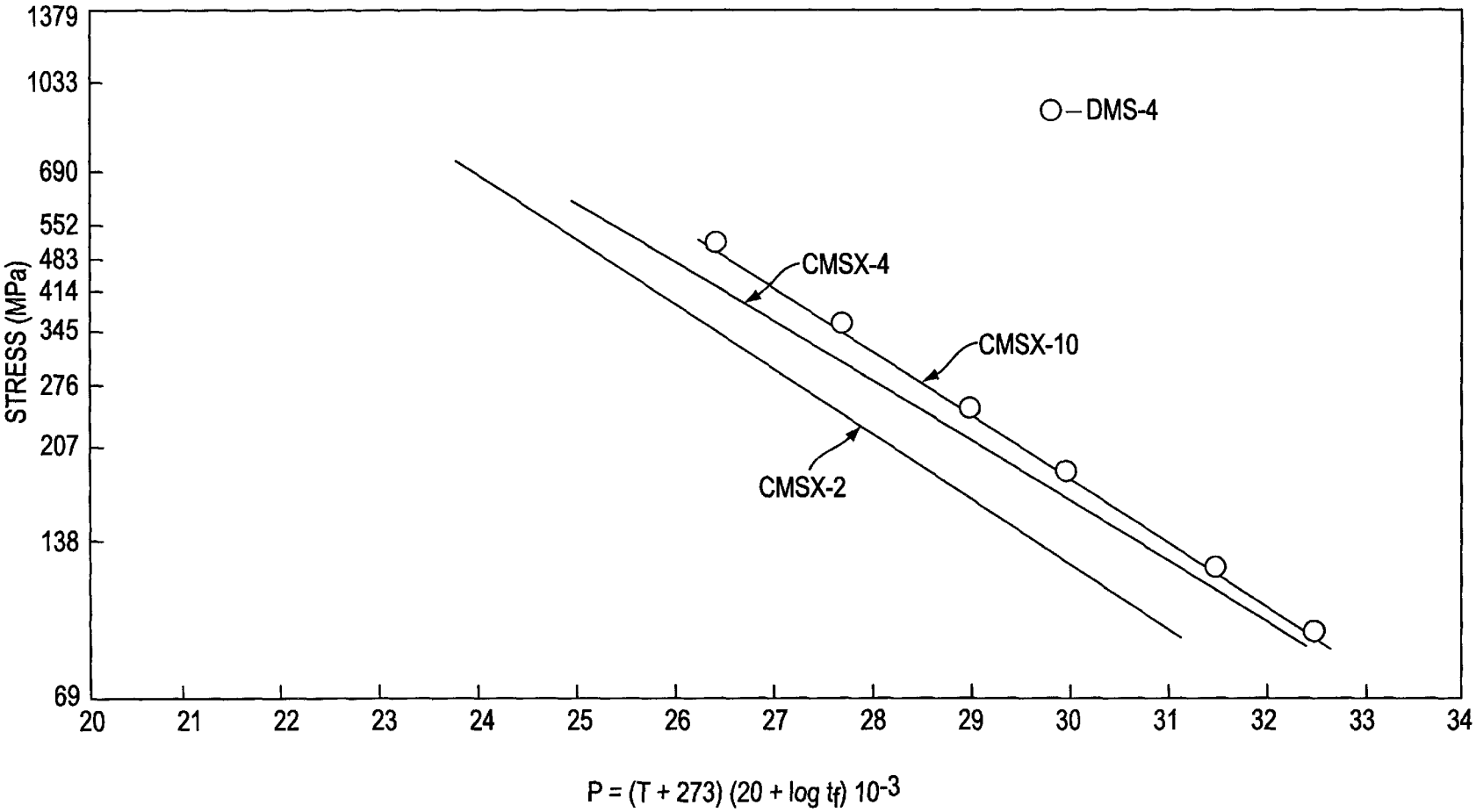
FIG. 6 is a graphical comparison of stress rupture data of this alloy with other alloys available for similar application.
Figure 7:
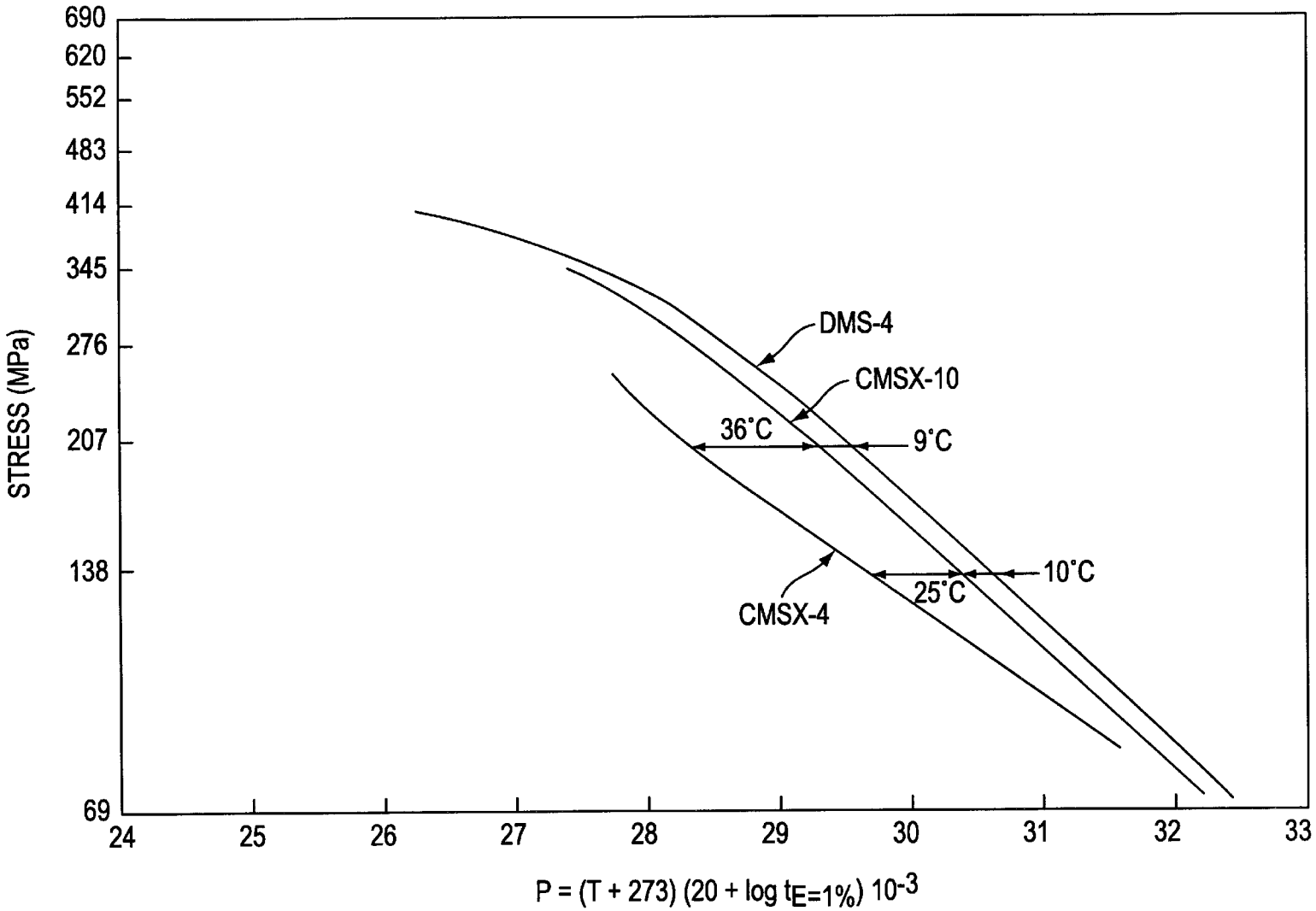
FIG. 7 is a graphical comparison of Larson-Miller plot for 1% creep strain of this alloy with the available data for currently used superalloys.

The solution treated and aged samples of alloys DMS-1 to DMS-6, prepared by the process by taking corresponding weight % of different alloying elements as given in table-1, were characterised for creep, oxidation and hot-corrosion resistance. The creep rupture tests were carried out within temperature and tensile stress ranges of 850 to 1200° C. and 70 to 500 MPa respectively. The creep-rupture life of different alloys DMS-1 to DMS-6 in comparison to the reported creep-rupture life of the known alloys, is given in table-2. Comparison of DMS-4 creep-repture data with those of the known alloys in the Larson-Miller plot of FIG. 6 shows alloy DMS-4 and CMSX-10 to have comparable characteristics. However, in the average Larson-Miller plot for 1% creep strength (FIG. 7), DMS-4 has 9 to 10° C. advantage over alloy CMSX-10 in terms of metal temperature capability. 1% creep strength is one of the most critical design parameters for application such as gas turbine blades and vanes since these components are never actually used in gas turbine engines till their repture.

For characterisation of bare oxidation and hot-corrosion behaviour, test samples of 7 mm diameter and 4 mm thickness were used. Oxidation weight loss have been evaluated after repeating thirty times the thermal cycle of heating a test piece at a temperature of 1100° C. in a crucible in air for 5 hours followed by air cooling to ambient temperature. Hot-corrosion weight loss have been determined by immersing each test piece in a salt mixture of 75 weight % sodium sulphate and 25 weight % sodium chloride contained in a crucible at a temperature of 940° C. for 50 hours. Table 2 shows the average weight loss by hot-corrossion and value of oxidation weight loss for each of the DMS-1 to DMS-6alloy along with the reported data for the known alloys. The table-2shows that the most preferred range of alloy compositions (DMS-3 to DMS-5) have better creep characteristics and adequate resistance to oxidation and hot-corrosion as compared to the known alloys.

For evaluation of the phase stability of different alloys DMS-1 to DMS-6, the samples of each alloy composition were exposed to temperatures between 1000 to 1200° C. for about 1000 hours. The alloys having compositions within the preferred range of this invention namely DMS-2 to DMS-5, exhibited excellent phase stability as no deleterious phase has formed. Sectioning of creep-ruptured samples also showed formation of no deleterious phase.

The test samples of alloys of the present invention were coated with an overlay coating applied by low pressure plasma vapor deposition process and some samples were also coated with platinum aluminide coating. Excellent coating characteristics, microstructure and bond strength have been obtained with both the coating processes.

The Ni-base single crystal superalloy articles such as gas turbine blades and vanes, prepared by the disclosed process in the present invention, have improved combination of critical properties such as high temperature creep resistance, hot-corrosion and oxidation resistance and excellent phase stability. Extremely complex cooling channels can be incorporated into these components without employing any ceramic core and without any compromise with aerodynamics requirements of cooling channels that is usually inevitable in components made using ceramic cores. Although particular embodiments of the invention have been described in detail for the purpose of illustration, various modifications may be made without departing from the spirit and scope of the invention.

What is claimed is:

1. A Ni-based superalloy, consisting of:

from 1.4 to 4.4 wt % of Cr;

from 3 to 8 wt % of Co;

from 5 to 7.5 wt % of W;

from 4.8 to 7.5 wt % of Re;

from 7.5 to 10 wt % of Ta;

from 4.8 to 5.8 wt % of Al;

from 0.1 to 0.2 wt % of Hf;

from 0.1 to 0.5 wt % of Nb;

from 0.01 to 0.05 wt % of Y;

balance Ni.

2. The Ni-based superalloy as claimed in claim 1, wherein W+Re have a sum which is 12 wt %.

3. The Ni-based superalloy as claim in claim 1, wherein Al, Ta, Hf, and Nb have a sum in wt % which ranges from 13.8 to 15.5.

* * * * *